United States Patent [19]

Lahr

[11] 4,231,183

[45] Nov. 4, 1980

[54] DIFFERENTIAL GEAR DRIVE

[75] Inventor: Robert G. Lahr, Reseda, Calif.

[73] Assignee: Ideal Toy Corporation, Hollis, N.Y.

[21] Appl. No.: 51,260

[22] Filed: Jun. 22, 1979

[51] Int. Cl.[3] ..... A63H 17/36; A63H 18/12; A63F 9/14

[52] U.S. Cl. ..... 46/262; 273/86 B; 46/258; 46/257

[58] Field of Search ..... 46/251, 252, 253, 254, 46/255, 256, 257, 258, 259, 260, 261, 262; 273/86 B

[56] References Cited

U.S. PATENT DOCUMENTS

| | | | |
|---|---|---|---|
| 3,453,970 | 7/1969 | Hansen | 46/251 |
| 4,141,553 | 2/1979 | Beny et al. | 273/86 B |
| 4,156,987 | 6/1979 | Lahr | 46/259 |

*Primary Examiner*—Gene Mancene
*Assistant Examiner*—Michael J. Foycik, Jr.
*Attorney, Agent, or Firm*—Richard M. Rabkin

[57] ABSTRACT

A toy vehicle for use in a toy vehicle game including an endless track defining at least two parallelly extending vehicle lanes in which two or more toy vehicles are adapted to be operated. The toy vehicles each include a reversible rotary drive motor and a transmission operatively engaged between the motor and two drive wheels for simultaneously driving the drive wheels in the forward direction, while selectively driving them at different speeds, in response to the direction of rotation of the drive motor, thereby to control the turning radius of the vehicle when changing lanes and biasing the vehicle against one or the other of the side walls of the track to guide the vehicle along its path of travel in one or the other of the lanes.

13 Claims, 7 Drawing Figures

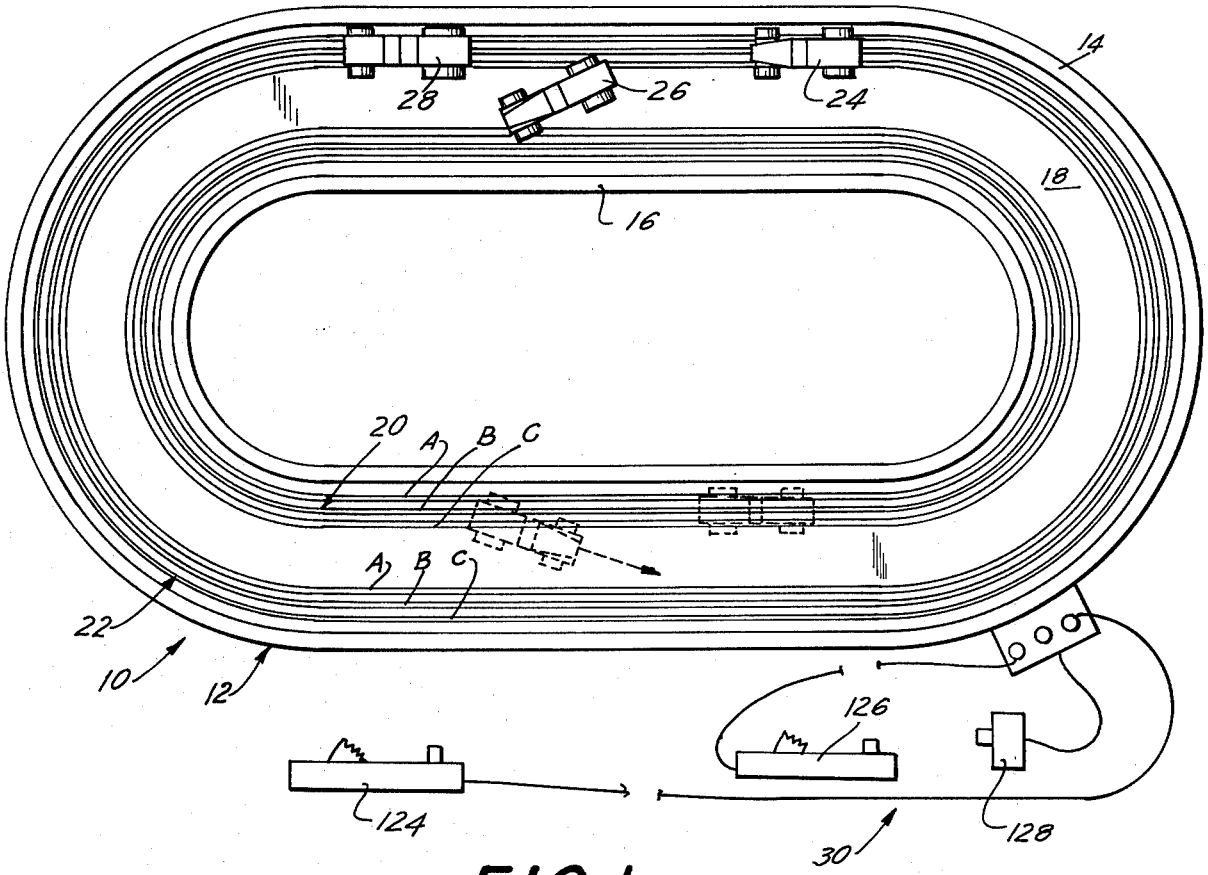
FIG. 1
FIG. 2
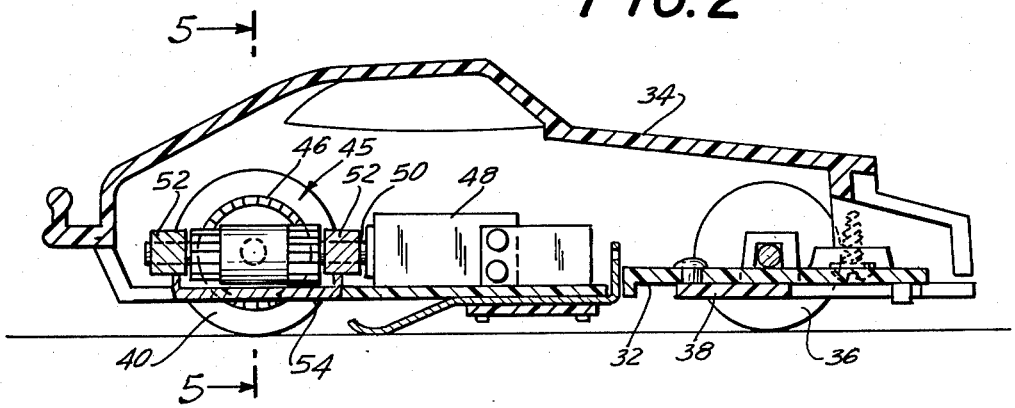

FIG. 3
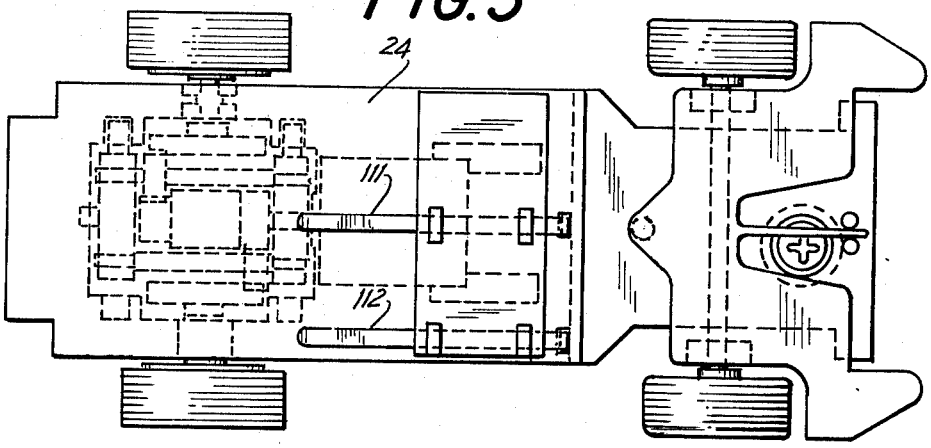
FIG. 3A
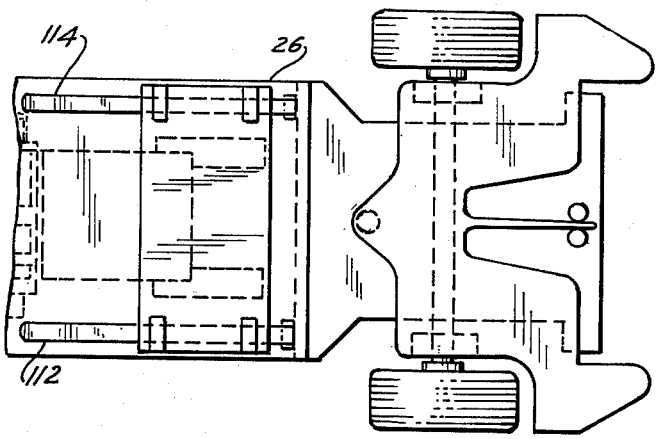
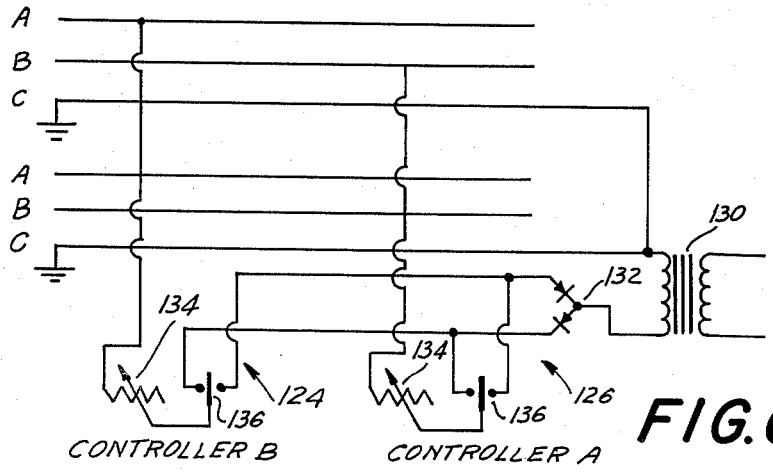
FIG. 6

FIG. 4
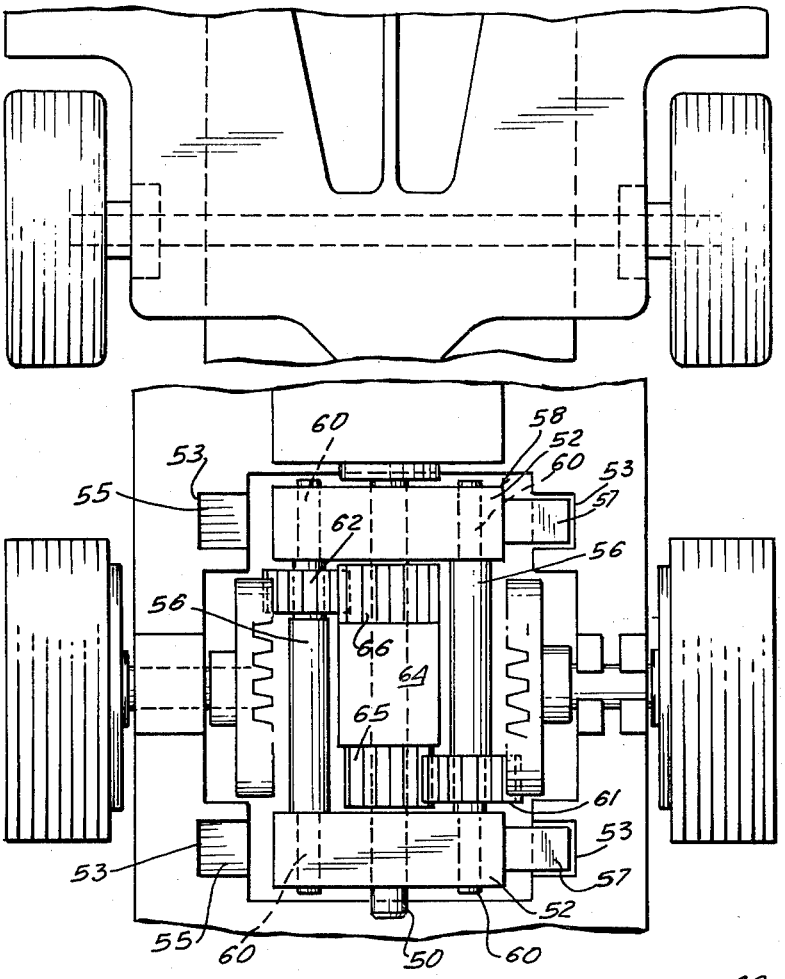
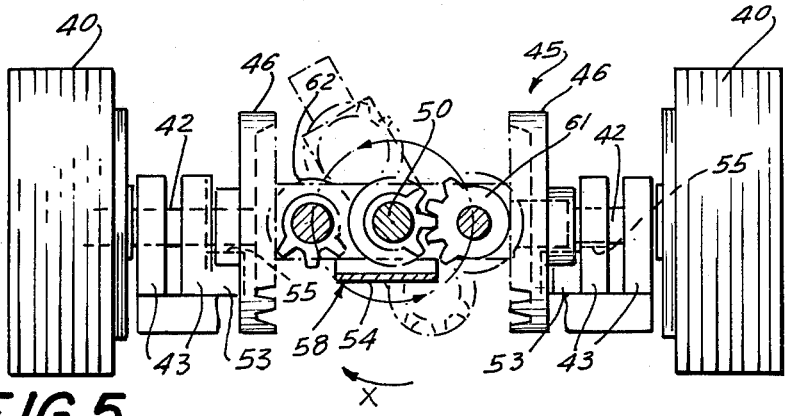
FIG. 5

DIFFERENTIAL GEAR DRIVE

The present invention relates to a toy vehicle and more particularly to a toy vehicle for use in a game in which toy vehicles are separately controlled by the players to enable them to turn out from one lane to the other and pass other vehicles on a track.

With the ever increasing popularity of toy vehicle games, such as for example the well known "slot car" games, there is an increasing demand for more realistic action. To this end attempts have been made to provide "slot car" type games with speed control systems, as for example by varying current flow to the vehicles in the game. To further enhance such realism the slot arrangements in such games also provide for crossing the vehicles from one side of the track to another to simulate an actual changing of lanes. However, the vehicle is in fact constrained to a fixed predetermined and unvariable path.

Since the play value of such "slot car" vehicle games is limited to the regulation of speed of travel, attempts have been made to provide toy vehicle games which enable an operator to control movement of the vehicle from one lane to the other without the constraint of a guide slot in the track. Such systems include, for example the type shown in U.S. Pat. No. 3,797,404, wherein solenoid actuated bumpers are used to physically push the vehicle from one lane to the other by selectively engaging the bumpers along the side walls of the track. It is believed that this type of system will not insure movement of the vehicle from one lane to the other, particularly at slow speeds, and the bumper movements for pushing the vehicle, are not realistic.

Other attempts to provide for vehicle control for moving the vehicle from one lane to the other involve relatively complicated steering control mechanisms which respond to the switching on and off of current to the toy vehicle as supplied through contact strips in the track surface. Such systems are disclosed for example in U.S. Pat. Nos. 3,774,340 and 3,837,286. However, in addition to the relative complexity of the steering arrangements, the vehicles will of course lose speed when the current supply is shut off, so that the vehicle will slow down and the realistic effect desired to be produced is affected.

Still other steering systems have been provided in toy vehicles wherein the vehicle's steering is controlled in response to a reversal of the polarity of the current flow to the electrical drive motor in the vehicle. Such systems are disclosed for example in U.S. Pat. Nos. 3,453,970 and 3,813,812.

One particularly successful toy vehicle game is disclosed in my earlier U.S. Pat. No. 4,078,799 and also in U.S. Pat. Nos. 4,141,553 and 4,141,552 wherein the rear drive wheels of the vehicle are selectively and independently driven to produce a biasing force on the vehicle which will cause the vehicle to switch lanes and be biased into guiding engagement along the sidewall of the track. That system provides a highly realistic racing game enabling the players to control vehicle speed and lane position during play of the game so that the players can cause their vehicles to switch lanes and pass another player's vehicle or a drone car on the track.

In accordance with an aspect of the present invention a controllable toy vehicle is provided for use with one or more toy vehicles in a race game similar to that of my prior U.S. Pat. No. 4,078,799, but in which the drive wheels of the vehicle are simultaneously driven at different speeds to control the turning radius of the vehicle while still producing the biasing force necessary to cause the vehicle to change lanes and be guided along the sidewall of the track.

The toy vehicle includes a frame, a body mounted on the frame, and a plurality of ground engaging wheels, including a pair of drive wheels. The drive wheels are mounted in the frame for rotation in laterally spaced vertical planes and a reversible electric motor is provided for driving the wheels. A drive transmission is mounted in the frame to connect the output of the electrical motor to the drive wheels. In one embodiment the drive transmission includes a transmission frame rotatably mounted in the vehicle for movement between two driving positions and on which a pair of idler gears are rotatably mounted for selective driving engagement with the drive wheels. The transmission frame also carries a pair of gear elements rotatably mounted thereon located respectively in meshing engagement with the idler gears and drivingly engaged with the motor. In this way the transmission frame and idler gears are moved between first and second positions in response to the direction of rotation of the drive motor, whereby the idler gears selectively drive the two drive wheels simulataneously, but at different speeds of rotation.

The gear elements on the transmission frame are not identical and have different numbers of gear teeth so that they drive their associated idler gears at different speeds. Thus the drive wheels will be simultaneously driven, but at different speeds, depending upon the direction of rotation of the output gear. Accordingly, the vehicles will move into engagement with and be guided along one of these side walls, depending on which of the rear wheels is driven at the higher speed.

The power supply to the electrical motors of the vehicles is provided through electrical contact strips located in the lanes of the vehicle track. This power supply system is constructed to enable the operators to separately control the speed of the vehicles and also to separately reverse the polarity of current flow to the electrical motors of the vehicles, whereby the vehicles will change lanes.

The above, and other objects, features and advantages of this invention will be apparent in the following detailed description of illustrative embodiments thereof, which are to be read in connection with the accompanying drawings, wherein:

FIG. 1 is a plan view of a toy vehicle game constructed in accordance with the present invention;

FIG. 2 is a longitudinal sectional view of the toy vehicle adapted for use with the game of FIG. 1;

FIG. 3 is a bottom view of one of the toy vehicles illustrated in FIG. 1;

FIG. 3A is a bottom view of the front end portion of a second vehicle used in the game of FIG. 1;

FIG. 4 is a top plan view of the toy vehicle shown in FIG. 2, but with the body removed;

FIG. 5 is a sectional view taken along line 5—5 of FIG. 2;

FIG. 6 is a schematic electrical circuit diagram of the electrical control system used for the toy vehicle game of FIG. 1.

Referring now to the drawings in detail, and initially to FIG. 1 thereof, the toy vehicle game 10, constructed in accordance with the present invention, includes an endless plastic track 12 having a pair of laterally spaced upstanding side walls 14, 16 and a road bed or tread surface 18 extending therebetween. The road bed 18 has a width sufficient to define at least two vehicle lanes 20, 22 thereon along which a plurality of vehicles can be operated.

In the illustrative embodiment of the present invention the toy vehicle game includes operator controlled vehicles 24, 26 which are of substantial identical construction except for the arrangement of their current collectors as described hereinafter. In addition, a drone car 28, which moves along the track at a relatively constant speed, may also be provided.

Vehicles 24, 26 are separately controlled by the players through a control system 30 which enables the players to vary current supply to the electrical motors in the vehicles, thereby to vary the vehicle speed. The controllers also enable the players to change the polarity of current supplied to the respective vehicle motors, whereby the vehicles can be switched by the players from one lane to the other. The drone car 28 on the other hand moves along the vehicle track at a constant speed providing an obstacle along the track which the player controlled cars 24, 26 must pass. The front wheels of the drone car are preferably canted in one direction or the other so that the drone will normally be driven in either the inner or the outer lane depending on the position of the wheels. This vehicle includes an electric motor operated by a battery contained within the vehicle, and connected through a direct drive transmission of any convenient construction to the rear wheels thereof. Preferably, drone vehicle 28 is of the type illustrated and described in detail in U.S. Pat. No. 4,141,552.

Toy vehicle 24 is illustrated in detail in FIGS. 2–4. As seen therein the vehicle includes a frame or chassis 32 of any convenient construction, and a removable plastic body or shell 34 which may be snap fit on frame 32 in any convenient manner. A pair of front wheels 36 are rotatably mounted on the frame, through a shock absorbing front end system 38, described more fully hereinafter, while the rear wheels 40 are rotatably mounted for independent rotation on frame 32 (See FIG. 5). Each of the drive wheels 40 is fixed on a separate shaft 42, in any convenient manner for rotation therewith. These shafts are rotatably supported in pairs of journal bosses 43 on frame 32 for independent rotation.

Each of the drive wheels 40 in the illustrative embodiment of the present invention is formed from either a molded plastic material or from a cast metal material. They are driven at different speeds, as described hereinafter, through a transmission system or means 45 which includes crown gears 46 that are respectively fixed to the wheel shafts 42 in any convenient manner.

The power for driving the toy vehicle is supplied from an electrical motor 48 mounted on frame 32 in any convenient manner. The electrical motor is of conventional construction and includes a rotary output member or shaft 50 connected to the rotor of the motor in the usual manner. This shaft is drivingly engaged with the transmission system 45 which is responsive to the direction of rotation of the shaft (i.e. the direction of rotation of the output shaft 50 of motor 48 due to the polarity of current supplied to the motor) to simultaneously drive both drive wheels 40 while driving one of those wheels at a predetermined faster R.P.M. than the other in accordance with the direction of rotation of the output shaft.

In the illustrative embodiment of the invention shown in FIGS. 2 and 4–6, transmission system 45 includes a gear support frame 58 freely rotatably mounted on drive shaft 50. The frame includes spaced end support bars 52 and an integrally formed connecting plate 54. A pair of support shafts 56 having reduced diameter end portions are press fit in apertures 60 formed in bars 52 in spaced parallel relation to shaft 50 and are held thereby against rotation in the bars. These shafts have larger diameter central portions between the bars 52 and have idler gears 61, 62 rotatably mounted thereon in spaced longitudinal relation, as seen in FIG. 4. The idler gears are freely rotatable on a reduced diameter portion of their associated shafts 56 and maintained in relatively fixed positions between the adjacent end bar 52 and the larger diameter portion of the shaft. The idler gears are provided with a different number of teeth, e.g. gear 61 has 9 teeth and gear 62 has 8 teeth. The shafts 56 and gears 61, 62 are dimensioned and located to engage crowngears 46 when transmission frame 58 is in either of its two driving or generally horizontal positions.

A gear element 64 having gears 65, 66 formed on the opposed ends thereof is press fit on drive shaft 50 for rotation therewith. The gears 65, 66 also have a different number of teeth, e.g. in the illustrative embodiment gear 66 has 9 teeth and gear 65 has 8 teeth. These gear ends are respectively engaged with gears 62 and 61 so that gear 62 is always driven at a slightly greater R.P.M. than gear 61, with the result that the wheel driven by gear 61 will always rotate slower than the wheel driven by gear 62.

Of course, it is to be understood that spur gear elements or sections 65, 66 may be separately formed and keyed to shaft 50 in any convenient manner, and also that the number of gear teeth used on the respective gears may be varied, as long as one drive wheel is driven at a faster rate than the other. The selected gear ratios determine the turning radius of the vehicle.

By this arrangement, when motor 48 is operated, the transmission frame will be rotated in either a clockwise or counterclockwise direction, as seen in FIG. 5, depending upon the polarity of the current supplied to motor 48, as a result of the forces applied to the frame due to the engagement of gears 61, 62 and 65, 66. That is gears 65 and 66 will be continuously rotated by the operation of motor 48 and, since frame 58 is freely rotatably mounted on shaft 50, the engagement between gears 65, 66 and gears 61, 62 will produce a resultant force on gears 61, 62 which will tend to rotate frame 58 in the same direction as gear element 64 and shaft 50. Thus when gear element 64 rotates in a clockwise or counterclockwise direction, frame 58 will be driven in the same direction. As a result, as seen in FIG. 5, when gear element 64 is rotated in a clockwise direction, indicated by the arrow X, frame 58 will rotate in a clockwise direction. This rotation of the frame brings gear 61 into driving engagement with the gear 46 on the right rear wheel 40 of the vehicle to drive that wheel at the slower speed as shown in solid lines in FIG. 5 while gear 62 engages gear 46 of the left wheel to drive it at the faster speed. Because of the offset relation of gears 61 and 62, the wheels 40 are both driven in a forward direction.

In the game illustrated in FIG. 1 when the vehicle is in the inside lane and its left rear wheel 40 is driven at a faster speed than its right wheel, as a result of the polarity of current supplied to motor 48, the toy vehicle will be caused to move from the inner lane 22 to the outer lane 20, as is shown in dotted lines in FIG. 1 occurring with the vehicle 26. When this occurs the front end of the vehicle will engage the outer wall 14 of the track and the continued drive of its left wheel at a greater speed will cause the vehicle to move along wall 14 in outer lane 22. By driving the left wheel at a slightly greater speed, with the relative speeds of the drive wheels being fixed by the gear ratios, the radius of the turn made by the vehicle in switching lanes is controlled and can be selected so that the vehicle does not impact against the side wall of the track at too great an angle.

If the angle of impact is too great, the vehicle may rebound off the side wall and fail to align its current collectors with the current supply strips in the track. By driving the rear wheels at a predetermined known speed differential, that angle of impact can be controlled so that the impact occurs at a smaller angle, thus reducing the possibility of an undesirable rebound.

When the polarity of current supplied to the motor 48 is reversed, frame 58 will rotate in a counterclockwise direction, as shown in dotted lines in FIG. 5. When this occurs, gear 62 will be rotated into engagement with gear 46 of the right driven wheel 40 (i.e. the right wheel 40 in FIG. 4) so that this wheel is driven at the faster speed.

When the right wheel of the vehicle is driven in this manner, a bias is applied to the vehicle which will cause it to move to the left. Thus, as illustrated in FIG. 1 by the vehicle 26 shown in solid lines, when the vehicle is in the outer lane 22 of track 12 and the polarity of the current flow to the motor 48 is changed so that its right wheel 40 is driven at the faster speed, the vehicle will be biased towards its left into inner lane 20. When the front end of the vehicle hits inner wall 16, it will continue to move along that inner wall in inner lane 20 until the polarity of current supplied to motor 48 is again reversed.

Of course, if the vehicle is moving at a relatively high rate of speed as it goes about a curve in the track while in the inner lane, it may be propelled by centrifugal force into the outer lane. However, if the faster drive to the right-hand wheel is maintained, it will move inwardly again to the inner lane as previously described.

As seen most clearly in FIG. 3, the vehicle chassis 32 includes vertically extending stop blocks 53 having free ends 55. These blocks are located to engage stop tabs 57 formed on the ends of bars 52 to limit rotation of frame 58 to 180°, i.e. to first and second positions in which gears 61 and 62 drivingly engage gears 46.

In order to supply current to the toy vehicle, track surface 18 is provided with a plurality of electrical contact strips in each of the lanes 20, 22. In the illustrative embodiment of the invention each lane is provided with three contact strips A, B and C respectively. The strips are formed of an electrically conductive metallic material and are embedded in the track so that they are substantially flush with the surface of the track and present no obstacle to movement of the vehicles from one lane to the other. Current is supplied to these strips, as described hereinafter, and is collected by current collectors mounted on the frame 32 of the toy vehicles in predetermined locations.

The contact strips in each lane are paired with each other, i.e. the A strip in one lane is electrically connected to the A strip in the other lane, the B strips are connected to each other and the C strips are connected to each other. The C strips are connected to electrical ground and the A and B strips are provided to separately supply current and control polarity of the current to the respective vehicles, so that two vehicles can operate in the same lane and still be separately controlled. For this reason, the current collector and the vehicles are arranged to associate the respective vehicles with only one of the pairs of contact strips. For example, vehicle 24 will obtain current from strips B, while vehicle 26 will obtain current only from strips A.

As illustrated in FIG. 3, vehicle 24 is provided with two current collectors 111, 112 with the current collector 112 thereof positioned to contact ground strip C. Similarly vehicle 26, illustrated in FIG. 3A, has current collectors 112, 114 mounted thereon with current collector 112 located in the same position as the corresponding collector of vehicle 24 for also contacting the ground strip C. These current collectors are mounted on the vehicle in any convenient manner known in the art, and are electrically connected in a known manner to motor 48 of their respective vehicles. Current collector 111 of vehicle 24 is mounted on the vehicle to engage contact strips B regardless of which lane the vehicle is in. As seen in FIG. 3, this current collector is located centrally of the vehicle frame. On the other hand, the current collector 114 of vehicle 26 is located off center from the center line of the vehicle body and in spaced relation to its associated current collector 112. This current collector is positioned to engage contact strips A regardless of the lane in which the vehicle is moving. By this arrangement, each of the operators can separately control current supply and polarity to contact strips A, B to control a respective one of the vehicles 24, 26 regardless of the lane occupied by the vehicle.

The control system 30 for the toy vehicle game illustrated in FIG. 1, is shown schematically in FIG. 6. This control system includes respective controllers 124, 126 by which the players can control the vehicles 24, 26 respectively. Essentially the control system includes a plug 128 by which the system can be connected to an electrical AC power source, and it includes a transformer 130. Power is supplied from the transformer 130 through a halfwave rectifier 132 including two diodes connected as shown to separately supply current to the controllers 124, 126. Each controller is provided as a hand-held unit and includes a variable resistor 134, operated as a trigger on the unit, as well as a single pole double throw switch 136. Current from controller 124 is supplied through its variable resistor 134 to the contact strips B and current from the controller 126 is supplied through its variable resistor to the contact strips A. The variable resistors may be of any convenient construction to permit the operators to vary the current supplied to their respective contact strips, and thus their respective vehicles, in order to vary the speed of the vehicles.

The polarity of the current supplied to the toy vehicles is separated and independently controlled by switches 136, which may, alternatively be movable diodes, so that polarity of current supplied to motor 48 of the respective vehicles, as controlled by the respective controllers, will vary in accordance with the position in which the switches 136 are placed. By this arrangement each player, using his controller 126 or 124, can control the speed of his vehicle along the track 12 and he can also variably position his vehicle along the track simply by changing the polarity of current supplied to the vehicle. As described above, the polarity of the current supplied to the motor of the respective toy vehicles will determine which of the two rear drive wheels rotates at the higher speed and this will determine which lane the vehicle will be driven to.

As illustrated in FIG. 1, when it is desired to switch a vehicle from the outer lane to the inner lane, as shown with vehicle 26, the polarity of current supplied to the vehicle is selected to drive the outer or right wheel of the vehicle at the higher speed thereby moving the vehicle leftwardly into the inner lane. Likewise, when it is desired to move the vehicle outwardly, the inner or left wheel of the vehicle is driven at the higher speed, by properly selecting the polarity of current supplied to the motor of the vehicle, so that the vehicle will move toward the right and into the outer lane. Thus the operators have complete control over both the speed of the vehicle and the lane in which the vehicle will move.

As mentioned, the toy vehicles of the present invention include shock absorbing front ends 38, and these front ends preferably have the same structure and function as those described in my earlier applications and therefore will not be described in detail herein.

Accordingly it is seen that a relatively simply constructed toy vehicle game is provided in which players have complete independent control over the speed of operation of the toy vehicles, including the ability to cause the toy vehicles to shift independently from one lane to the other at a controlled turning radius in order to pass each other or to pass a drone car moving along the track in a constant speed. This is achieved without the complexities of multiple element steering systems or solenoid bumper and steering arrangements. Moreover, it is accomplished with a simple change in polarity of the current flow to the toy vehicle's motor and eliminates the attendant loss of speed which occurs with previously proposed structures wherein lane changes are provided as a result of shutting off of power to the vehicle motor.

Although illustrative embodiments of the present invention have been described herein with reference to the accompanying drawings, it is to be understood that the invention is not limited to that precise embodiment, but that various changes and modifications may be effected therein by one skilled in the art without departing from the scope or spirit of this invention.

What is claimed is:

1. In a toy vehicle comprising a vehicle frame, a pair of laterally spaced drive wheels mounted on the vehicle in laterally spaced relation to each other for rotation in vertical planes, and a reversible rotary drive motor in said frame including a power output element, wherein the improvement comprises gear train means operatively connected between said motor output element and said drive wheels for simultaneously driving both of said drive wheels while selectively driving one of the drive wheels at a greater rotational speed than the other in response to the direction of rotation of said output element.

2. A toy vehicle as defined in claim 1 wherein said gear train includes a gear frame mounted for movement between first and second positions in response to the direction of rotation of said output element, first and second idler gears mounted in said frame in position to selectively engage said drive wheels in response to the direction of rotation of said output element, and a pair of gears respectively drivingly engaged with said idler gears but having a different number of gear teeth, said pair of gears being operatively connected to and driven by said output element.

3. A toy vehicle as defined in claim 2 wherein said drive wheels each have a crown gear drivingly engaged therewith and positioned to be engaged by said first and second idler gears, and cooperating means on said vehicle frame and said gear frame for limiting pivotal movement of the gear train between first and second positions wherein said first and second drive gears engage said crown gears.

4. A toy vehicle as defined in claim 4 wherein said pair of gears are integrally formed and rotatably mounted on said gear frame in axial alignment and driving engagement with said output element.

5. In a toy vehicle including a frame, a body mounted on said frame, a plurality of ground engaging wheels mounted in said frame and including a pair of drive wheels; means for mounting said drive wheels in said frame for rotation in laterally spaced vertical planes; a reversible electric motor mounted in said frame having an output shaft and drive transmission means mounted in said frame for drivingly connecting said motor output shaft to the respective drive wheels, wherein the improvement comprises said transmission means including a transmission frame movably mounted in the vehicle frame for movement between first and second positions in response to the direction of rotation of the output shaft, a pair of idler gears mounted on the transmission frame for rotation therewith and positioned to selectively drivingly engage said drive wheels in said first and second positions of said transmission frame; and a pair of gear elements rotatably mounted in said transmission frame in respective driving engagement with said idler gears and drivingly engaged with said output shaft; said gear elements having different numbers of gear teeth whereby during operation of said motor both of said drive wheels are driven but one drive wheel will be driven at a great rotary speed than the other depending upon the direction of rotation of said output shaft.

6. In a toy vehicle as defined in claim 5 wherein said drive wheels each have a crown gear operatively associated therewith and said idler gears comprise a pair of gears rotatably mounted in said transmission frame on axes generally parallel to the axis of rotation of said output shaft, said idler gears being respectively associated with said crown gears for respective operative engagement therewith in said first and second positions of the transmission frame; said idler gears having different numbers of gear teeth selected in accordance with the number of gear teeth on the gear elements with which they are engaged whereby one of the idler gears rotates at a greater R.P.M. than the other.

7. In a toy vehicle as defined in claim 6 wherein said pair of gear elements comprise a one piece collar rotatably mounted on the gear transmission frame and having a pair of spur gears formed on the opposed ends thereof with different numbers of teeth and engaged respectively with said idler gears whereby said gear elements rotate at the same speed and cause the transmission frame to rotate in response to the rotation thereof in a direction determined by the direction of rotation of the output shaft of the motor thereby to selectively drive one of said drive wheels at a faster speed than the other in accordance with the drive direction of the output shaft.

8. In a toy vehicle game including a guide track having a pair of upstanding laterally spaced side walls, and at least one toy vehicle on said track including a frame, a body mounted on said frame, a plurality of ground engaging wheels mounted in said frame and including a pair of drive wheels; means for mounting said drive wheels in said frame for rotation in laterally spaced vertical planes; a reversible electric motor having an output shaft and being mounted in said frame and drive transmission means mounted in said frame for drivingly connecting said motor to the drive wheels; wherein the improvement comprises said transmission means including gear train means for simultaneously driving both of said drive wheels while selectively driving one of the drive wheels at a greater rotational speed than the other in accordance with the direction of rotation of the output shaft thereby to control the turning radius of the toy vehicle when changing lanes from one lane to the other and bias the vehicle into guiding engagement with the adjacent side wall of the track.

9. In a toy vehicle as defined in claim 8 wherein said gear train includes a gear frame mounted for movement between first and second positions in response to the direction of rotation of said output element, first and second idler gears mounted in said frame in position to selectively engage said drive wheels in response to the direction of rotation of said output element, and a pair of gears respectively drivingly engaged with said idler gears but having a different number of gear teeth, said pair of gears being operatively connected to and driven by said output element.

10. In a toy vehicle game as defined in claim 9 wherein said drive wheels each have a crown gear drivingly engaged therewith and positioned to be engaged by said first and second idler gears, and cooperating means on said vehicle frame and said gear frame for limiting pivotal movement of the gear train between first and second positions wherein said first and second drive gears engage said crown gears.

11. In a toy vehicle game as defined in claim 10 wherein said pair of gears are integrally formed and rotatably mounted on said gear frame in axial alignment and driving engagement with said output element.

12. In a toy vehicle game including a frame, a vehicle body mounted on said frame, a plurality of ground engaging wheels rotatably mounted on said frame and including a pair of laterally spaced drive wheels; means for mounting said drive wheels in said frame for rotation in laterally spaced vertical planes; a reversible electric motor mounted in said frame and having a rotary power output element; drive transmission means mounted in said frame for drivingly connecting said output element to the respective drive wheels; wherein the improvement comprises said transmission means including a transmission frame movably mounted in the vehicle frame for movement between first and second positions in response to the direction of rotation of the output shaft, a pair of idler gears mounted on the transmission frame for rotation therewith and positioned to selectively drivingly engage said drive wheels in said first and second positions of said transmission frame; and a pair of gear elements rotatably mounted in said transmission frame in respective driving engagement with said idler gears and drivingly engaged with said output shaft; said gear elements having different numbers of gear teeth whereby during operation of said motor both of said drive wheels are driven but one drive wheel will be driven at a greater rotary speed than the other depending upon the direction of rotation of said output shaft thereby to control the turning radius of the toy vehicle when changing lanes from one lane to the other and bias the vehicle into guiding engagement with the adjacent side wall of the track.

13. In a toy vehicle as defined in claim 12 including cooperating means on said vehicle frame and said transmission frame for limiting rotary movement of the transmission from between said first and second positions.

* * * * *